US008506195B2

(12) United States Patent
Diaz

(10) Patent No.: US 8,506,195 B2
(45) Date of Patent: Aug. 13, 2013

(54) NECK BRUSH SANITIZER WITH POWDER DISPENSER

(76) Inventor: Ricky Diaz, Sunny Isles Beach, FL (US)

( * ) Notice: Subject to any disclaimer, the term of this patent is extended or adjusted under 35 U.S.C. 154(b) by 242 days.

(21) Appl. No.: 13/220,289

(22) Filed: Aug. 29, 2011

(65) Prior Publication Data

US 2013/0047357 A1 Feb. 28, 2013

(51) Int. Cl.
*B43K 29/00* (2006.01)

(52) U.S. Cl.
USPC ..... 401/195; 401/2; 401/270; 422/300; 422/24; 250/455.11

(58) Field of Classification Search
USPC ..... 401/195, 1, 2, 270, 279, 282; 422/300, 422/301, 24; 250/455.11, 454.11
See application file for complete search history.

(56) References Cited

U.S. PATENT DOCUMENTS

| | | | | |
|---|---|---|---|---|
| 1,714,508 | A | 5/1929 | Keele | |
| 1,757,650 | A | 5/1930 | Arico | |
| 2,129,777 | A | 9/1938 | McGrath | 21/88 |
| 2,428,306 | A | 9/1947 | Beagle | 15/147 |
| 2,582,992 | A | 1/1952 | Hergert | 15/194 |
| 2,582,020 | A | 4/1952 | Farone | 15/226 |
| 2,657,410 | A | 11/1953 | Stroup | 15/131.1 |
| 2,825,080 | A | 3/1958 | Bongiovanni | 15/131.1 |
| 2,966,176 | A | 12/1960 | Bradley | 141/370 |
| 4,403,364 | A | 9/1983 | Shcroeder | 15/4 |
| 4,740,706 | A * | 4/1988 | Murdock, III | 250/455.11 |
| 5,380,069 | A | 1/1995 | Klinkhammer | 300/21 |
| 7,213,603 | B2 * | 5/2007 | Pinsky | 132/310 |
| 7,874,753 | B2 | 1/2011 | Domy et al. | 401/99 |
| 8,185,994 | B2 * | 5/2012 | Brackett et al. | 15/38 |
| 2006/0175554 | A1 | 8/2006 | Riddell | 250/455.11 |
| 2009/0044361 | A1 | 2/2009 | Rash | 15/210.1 |

OTHER PUBLICATIONS

Powder Neck Brush—CoolBlades Professional Hair & Beauty Supplies & Salon Equipment—www-coolblades.co.uk/powder-neck-brush-html.

* cited by examiner

*Primary Examiner* — David Walczak
(74) *Attorney, Agent, or Firm* — Robert C. Kain, Jr.

(57) ABSTRACT

The sanitized brush, with skin powder, is retained in a sanitization system. The neck brush handle has a powder chamber, a bristle face with outwardly extending bristles and a powder input port. A portion of the powder chamber wall is flexible and a movable actuator depresses the flex-wall, compresses the size of the chamber and forces powder from an exit port on the bristle face. The sanitization system includes a brush stand holding the brush above a UV lamp. A sensor determines when the brush is on the stand and a timer is triggered ON controlling the lamp and counts down OFF. Additional features include: a base supporting the stand above the UV lamp; a rechargeable battery; an on-hook brush sensor (mechanical or optical); and a removable cover with a transparent segment to visually confirm lamp ON condition.

10 Claims, 3 Drawing Sheets

NECK BRUSH SANITIZER WITH POWDER DISPENSER

The present invention relates to a sanitization system combined with a neck brush wherein the brush contains skin powder customarily brushed on a salon patron.

BACKGROUND OF THE INVENTION

Neck brushes have been used to clean cut hair from a salon patron's neck for centuries. These simple brushes are sometimes dipped into skin powder which soothes the patron's neck. More recently, brushes were developed to hold the powder and dispense the powder.

U.S. Pat. No. 2,966,176 to Bradley discloses improvements in a brush holder and powder applicator for a barber's duster brush. Powder container D is squeezed and powder is delivered to brush bristles. A "germicidal lamp H" sanitizes the powder. U.S. Pat. No. 1,757,650 to Arico discloses a brush with a powder containing chamber at one end. The brush has an independent brush head to be used upon each customer when it is desired to remove the cut hairs from the face, head or neck, under such conditions providing for sanitation. U.S. Pat. No. 2,657,410 to Stroup discloses a neck duster especially useful in barber and beautician shops. The neck duster has a disposable container for antiseptic powder and the container has a perforated top to permit passage of the powder to the bristles of a brush head. The container and the brush head are detachably secured together by means of a handle. U.S. Patent Application Publication No. 2006/0175554 to Riddell discloses a germicidal brush cleaner that uses a germicidal UV light (para. 024) to disinfect the individual bristles on a plurality of toothbrushes and a hairbrush. Each toothbrush and hairbrush includes bristles made of optical fibers capable of transmitting ultraviolet light. There is also a special method of attachment of the toothbrush inside the cleaner that secures the toothbrushes in a set position in the holder. The germicidal light source may be a germicidal fluorescent ultraviolet lamp. The light rays from the germicidal light source are directed at the opposite ends of the bristle at the critical angle, or slightly greater than the critical angle, in order to attain total internal reflection of the light down the bristles of the toothbrushes.

The other references showing neck brushes are: U.S. Pat. No. 2,592,020 to Farone discloses disposable sanitary-type neck dusters. U.S. Pat. No. 1,714,508 to Keele discloses a sanitary brush. U.S. Pat. No. 2,825,080 to Bongiovanni discloses a combination neck brush and powder dispenser for use by a barber. U.S. Pat. No. 2,129,777 to McGrath discloses a system, used in connection with barbers' duster brushes, wherein the bristles of the brush may be sterilized each time the brush is used. U.S. Pat. No. 2,582,992 to Hergert discloses a brush or duster for use in barber shops.

However, current health code regulations require that most, if not all, barbershop and salon utensils, which touch a patron's hair or neck, be sterilized before and between each use. The utensil should be sterile for each use. Therefore, many of the prior art neck brushes, with and without powder dispensers, do not have a sanitization system. Further, many health code regulations require that the government inspector visually see, during a quick inspection of the salon, that the sanitization process is being properly applied to all beauty salon and barbershop utensils.

OBJECTS OF THE INVENTION

It is an object of the present invention to provide a sanitization system and a neck brush wherein the brush contains skin powder to be used on a salon patron.

It is an additional object of the present invention to have a sanitization system wherein ultraviolet light ("UV") is directed to the brush bristles and any retained skin powder held by the brush bristles.

It is another object of the present invention to provide a system wherein the sanitization process by the ultraviolet UV lamp can be confirmed without opening the canister.

It is a further object of the present invention to provide a canister which holds the sanitized brush and brush skin powder.

SUMMARY OF THE INVENTION

The sanitized brush, with skin powder, is retained in a sanitization system. The neck brush has a brush handle, a bristle face and a plurality of bristles extending outward from said bristle face. The brush handle is a two-piece element (in the preferred embodiment) and the handle defines an interior chamber which holds skin powder therein. The powder is adapted to be applied to a neck of a salon patron by an operator who brushes cut hair form the neck of the patron during a hair styling operation. The brush handle has a powder loading port therein to permit access to the interior chamber such that said skin powder can be delivered into said chamber. A portion of the chamber wall of the interior chamber is flexible. A movable actuator disposed in the handle has an operator surface and an actuator end on the flexible chamber wall. When the actuator is depressed by the operator, the wall moves inward which compresses the size of the chamber. The bristle brush face defines a powder exit port and this port adjoins an exit passage extending from the bristle face to the chamber such that upon actuation of the operator surface and resultant movement of the flexible chamber wall, the chamber compresses resulting in the ejection of skin powder from the chamber through the exit passage and the exit port into the plurality of bristles extending outward from the bristle face. The sanitization system also includes a brush stand to support the neck brush about the brush handle and a sensor system to determine when the neck brush is disposed on the brush stand. The sensory system is an on-the-hook mechanical or optical system (when the brush is on the stand hook arm). An ultraviolet UV sanitizing lamp is directed at the plurality of bristles and any retained powder captured therein. A timer, electrically coupled between a power source and the lamp, is triggered ON by the sensor system and supplies power to the lamp for a predetermined period of time, and thereafter disconnects the power from the lamp when the timer counts down and turns OFF.

Additional features of the sanitizing neck brush system include: (a) a base supporting the brush stand (the stand extending upwards from the base), wherein the stand retains brush bristles vertically above the UV lamp; (b) a battery and a recharger unit; (c) the sensor system configured as a mechanical switch on or in or connected to a movable stand, or an optical sensor controlled switch; and (d) a cover removably mounted atop the base to cover the brush on the stand wherein the cover has a transparent wall segment to visually confirm a lamp ON condition.

BRIEF DESCRIPTION OF THE DRAWINGS

Further objects and advantages of the present invention can be found in the detailed description of the preferred embodiments which follow when reviewed in conjunction with the accompanying drawings in which.

DETAILED DESCRIPTION OF THE PREFERRED EMBODIMENTS

The present invention relates to a sanitization system for a neck brush wherein the brush contains skin powder to be used on the neck of a salon patron. Similar numerals designate similar items throughout the drawings.

Figure 1:
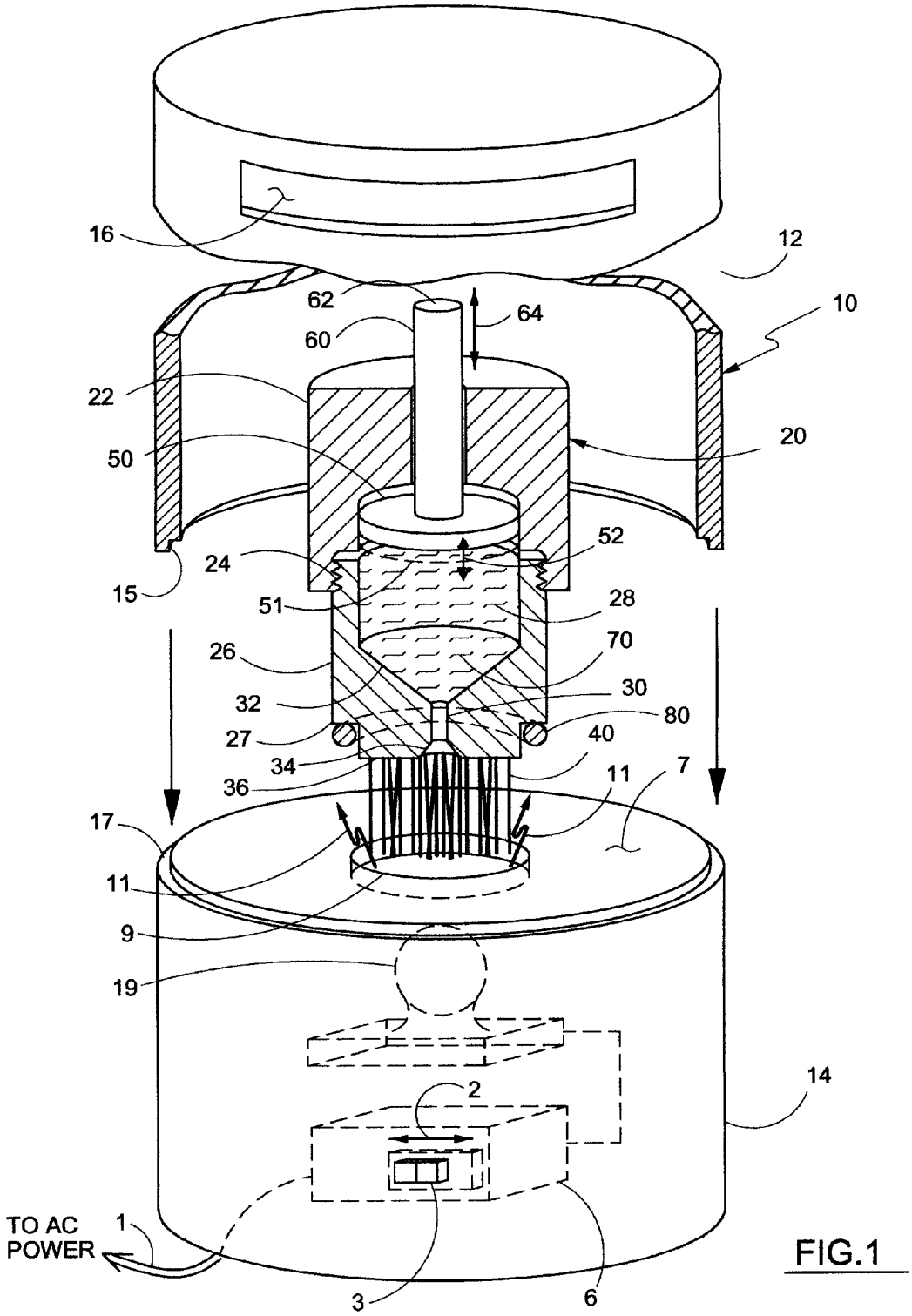
FIG. 1 diagrammatically illustrates the sanitization system and neck brush which contains skin powder therein.

FIG. 1 diagrammatically illustrates sanitization system 10 which generally encases and retains neck brush 20. Brush 20 contains skin powder 70. The sanitization system or unit 10, in the preferred embodiment, includes a removable upper cover 12 and a base 14. Cover 12 may be entirely transparent but if not entirely clear, at least an area designated as window 16 should be transparent. Window 16 (or the entire cover if the entire cover is transparent) must be somewhat near light emitting port 9 on top, flat surface 7 of base 14. Light emitting port 9 emits ultraviolet or UV light 11 shown by arrows 11 emitting from light port 9. Therefore, the UV light 11 is generally visible through transparent window 16 (or the entire cover 12 if the cover is clear or transparent). Cover 12 has an edge fitting or complementary notch or step 15 which matches notch or step 17 in base 14. In this manner, when cover 12 is placed on base 14, a relatively sanitized area is established in the inside of the cover and atop the base as a sanitization system. As an additional feature, notch 15, 17 may include an O ring to enhance the sanitization and sanitary nature of the interior space of the entire system.

Inside base 14 is a UV light or lamp diagrammatically shown as UV light system 19, and a power conversion and control system 6. A manual ON/OFF switch 3 can be utilized to turn ON and OFF UV lamp 19 as shown by double headed arrow 2. The electrical power control system 6 for UV lamp 19 is supplied line power generally by an AC cord 1 leading to an AC power source. As explained later, electrical system 6 may include a battery which is rechargeable by the AC power source.

In the illustrated embodiment, brush 20 is a two part brush wherein the top brush handle 22 is threadably attached via threads or other snap-on or other locking mechanism 24 to lower brush body 26. In the illustrated embodiment, a chamber 28 is defined by the lower brush body 26. In a different embodiment, chamber 28 is located in upper handle body 22 and only exit passage 30 extends through lower handle body 26. As shown in FIG. 1, chamber 28 has at its bottom segment, a frustoconical narrowing segment 32 leading to exit passage 30. An exit port 34 is defined on brush bristle face 36. A plurality of bristles 40 extend outwardly from bristle face 36. When on the stand bristle face 36 is parallel to UV lamp lens 9 to assure UV light distribution over all the bristles.

In the illustrated embodiment, the upper handle body 22 has a flexible chamber wall 50. Chamber wall 50 moves inward toward chamber region 28 as shown by double headed arrow 52. The flexible chamber wall 50 compresses chamber 28 based upon movement of actuator 60. Actuator 60 is movably disposed in upper handle segment 22. The actuator moves up and down. Actuator 60 has an operator interface 62 and moves up and down as shown by double headed arrow 64. When the operator depresses surface 62, actuator 60 is depressed thereby moving flexible wall 50 to a position shown by dashed line 51. When the flexible wall 50 is moved downward by actuator 60, the volume or space in chamber 28 is compressed or reduced thereby forcing skin powder 70 retained within chamber 28 to be ejected or forced through exit passage 30 and out exit port 34 and into the plurality of bristles 40. Flexible wall 50 is biased to force actuator 60 upward after the depression operation. If the chamber compression and release is too forceful, powder may not be adequately ejected. A one-way valve, which permits air to be drawn into chamber 28 during the upward return of actuator 60, may be incorporated into brush 20. The valve relieves the "return vacuum" caused by retraction.

When the UV light 11 is turned ON by the electrical system 6, UV rays illuminate the plurality of bristles 40 and any retained skin powder held by the bristles. Powder 70 in chamber 28 is maintained in a sterile condition since the powder is sterile when it is placed in the container. The powder is placed in container or chamber 28 by the user threadably removing upper handle 22 from lower handle 26 via threads 24. A snap or an O ring lock may be use rather than threads 24. In any event, the user places sterile powder in chamber 28 and then seals the upper handle unit 22 to the lower unit handle 26. Therefore, the powder in chamber 28 is maintained in sterile condition and the sterile condition is maintained until the powder is ejected into bristles 40. During use, the salon operator, barber or beautician opens cover 10 by vertically moving the cover upwards from base 14 thereby exposing brush 20 and bristles 40. The operator then removes the brush from brush stand 80 and brushes the salon patron's neck depositing powder on the skin of the patron. The user then replaces brush 20 on a brush stand 80. The brush stand 80 is attached to the base 14 as discussed later in connection with FIG. 3A. As discussed later, when brush 20 is placed on stand 80, lamp 19 is activated and UV rays 11 illuminate bristles 40 and any retained powder in the bristles thereby sanitizing the brush 20, bristles 40 any retained powder in bristle 40 and generally the entire inside of the container. It is preferred that the operator replace cover 10 onto base 14 thereby permitting UV light 11 to sterilize the entire interior of the container.

When health officials or other governmental agency members visit the salon or barber shop, those officials can easily see that the UV lamp is turned ON thereby sterilizing the entire neck brush and any exposed powder.

Figure 2:
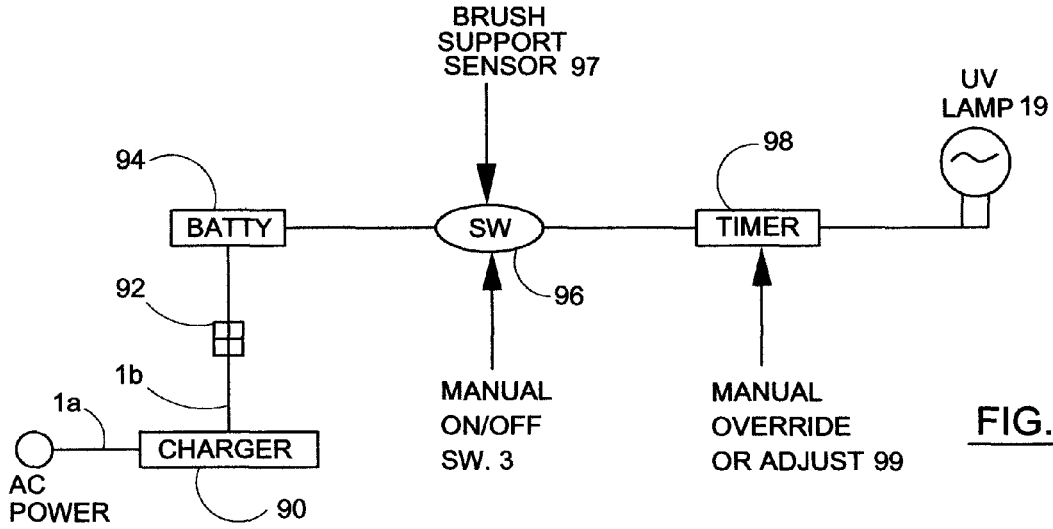
FIG. 2 diagrammatically illustrates a simple electronics diagram for the system.

FIG. 2 diagrammatically illustrates one basic electrical system for powering UV lamp 19. AC power is supplied on line 1*a* to a charger unit 90. Charger unit 90 converts the AC power to DC power and applies the same to line 1*b*. A coupling 92 permits the user to plug and unplug charger 90 from base 14 and electrical system 6. The coupler may be on a surface of base 14. Electrical unit 6 includes, in a preferred embodiment, a rechargeable battery 94 and a switch 96 activating timer 98 which supplies power to UV lamp 19. Of course, the electrical system may be more complex since timer 98 could be a digital timer that turns ON and OFF a power switch (not shown) directly coupling battering 94 to UV lamp 19. Further, the power supply to UV lamp 19 may need conditioning to increase or decrease voltage or applied to the current. Persons of ordinary skills in the art would know how to provide such conditioned power to lamp 19 as well as how to turn ON or OFF lamp 19 based upon the output of timer 98. Switch 96 is controlled either manually by ON/OFF switch 3 (a slide switch shown in FIG. 1) or other types of manual switches (other than a slide switch). More importantly, switch 96 is controlled by a brush support sensor 97 that will be discussed later in connection with FIGS. 3A and 3B. If manual switch 3 is in the OFF position, when brush support sensor 97 is activated by the brush mounted on stand 80, switch 96 is closed thereby feeding power from battery 94 through the timer 98 to UV lamp 19. Timer 98 is utilized to keep the lamp 19 ON for a certain period of time (a predetermined period of time) and then automatically turned OFF. This time may be set by a health code regulation or may be subject to a manual override or some type of multiple time on period adjustment. In other words, adjuster 99 may be a multi-position switch turning ON the timer for 1 hour, 2 hours, or 3 hours (a three position switch). The manual override could be used to turn OFF the timer such that as long as the brush is on handle 80 (FIG. 1 and FIGS. 3A and 3B), the UV lamp is ON (an always ON automatic control). In this different control system, the salon operator would turn ON or OFF the UV lamp by manual switch 3. In this manner, the system can be adjusted depending upon the health code regulations for particular salons. Some health codes would require the UV lamp to be ON during all normal business hours (manual switch ON, timer disconnected or "always on") whereas other health codes may require the UV lamp to be ON only for a certain predetermined periods of time such as 1 hour, 2 hours etc. The present system provides a sanitization unit for multiple jurisdictions having different health regulations.

In addition, the AC power source in charger 90 may be eliminated. In other words, the system may be powered simply by a battery 94 that is periodically replaced by the salon operator. An electrical unit to convert the AC power will be required. Since the cover 12 has a view port 16, the salon operator can easily determine when the UV lamp is permanently OFF indicating that battery 94 has been fully depleted of power and needs replacement.

Figure 3A:
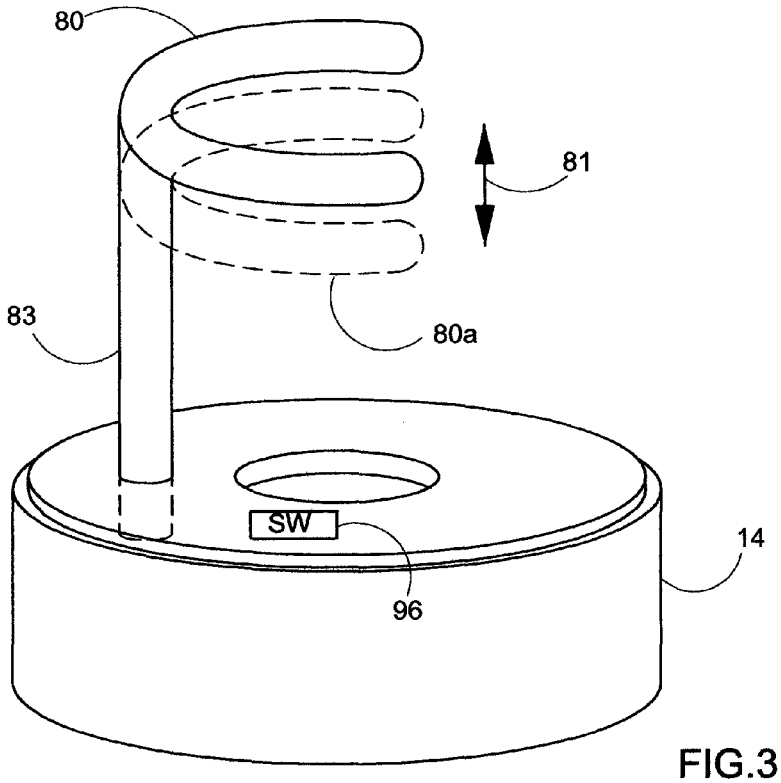
FIGS. 3A and 3B diagrammatically illustrate sensor systems to determine when the brush is resting on the brush stand in the sanitization case.

FIG. 3A shows that brush stand 80 has a horseshoe or U-shaped configuration which partly wraps around the lower region of brush segment 26. Returning to FIG. 1, brush region 26 has a lower lip 27 that is complementary to brush stand arm 80. Returning to FIG. 3A, brush stand 80 moves vertically up and down on base 14 as shown by double headed arrow 81. In the lower position 80*a*, stand 80 and particularly stand post 83 activates switch 96 thereby turning ON the timer 98 and ultimately UV lamp 19. The post is biased upward such that when the brush is not on the stand, the post moves slightly upward turning OFF the UV lamp. If the brush is removed while timer 98 is still in the countdown ON timing session, the power to the UV lamp remains ON. Returning the brush to stand 80 may reset timer 98 such that the timer 98 keeps UV lamp 19 ON for a predetermined time. The predetermined time is set to be equal and to exceed the time required by the health code regulations.

Figure 3B:
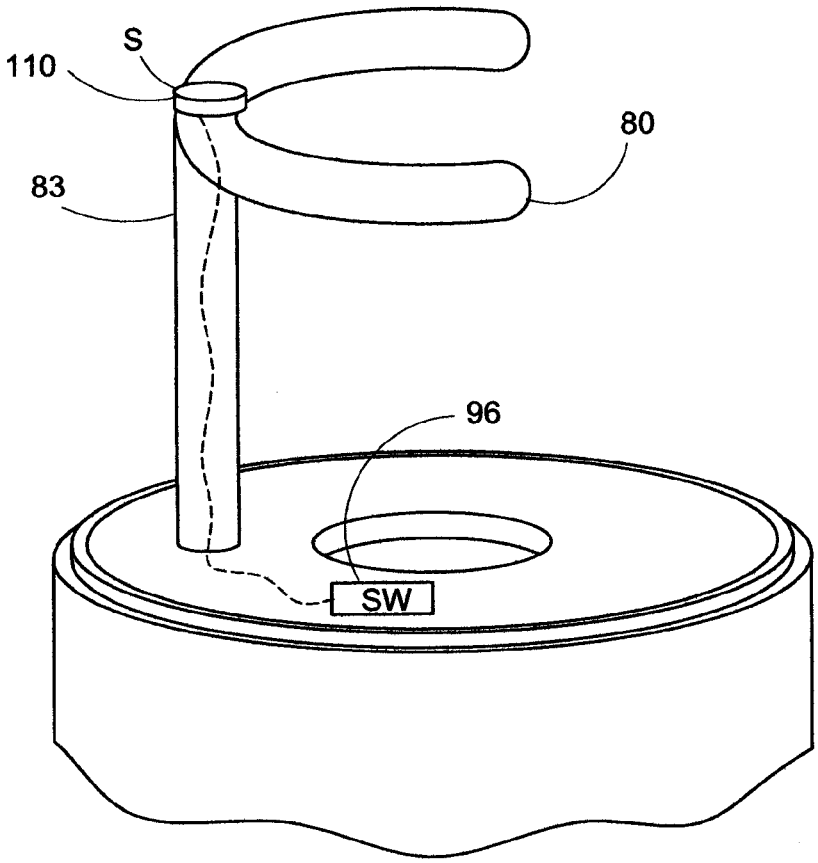

FIG. 3B shows that brush stand 80 has a sensor 110 proximate the brush 20. Sensor 110 could be a mechanical switch that is directly activated and actuated by brush handle segment 26 (when the brush is on the stand) or sensor 110 may be an optical sensor which detects the difference in light when the brush 20 is on stand 80 as compared as when the brush is off the stand 80. The output from sensor 110 is fed to switch 96.

The claims appended hereto are meant to cover modifications and changes within the scope and spirit of the present invention

What is claimed is:

1. A sanitization system and neck brush containing powder comprising:

a neck brush with a brush handle, a bristle face and a plurality of bristles extending outward from said bristle face;

the brush handle defining an interior chamber having a chamber wall with skin powder therein, said powder adapted to be applied to a neck of a salon patron during a hair styling operation;

the brush handle having a powder loading port therein to access said interior chamber such that said skin powder can be delivered into said chamber;

a portion of said chamber wall being flexible;

a movable actuator disposed in said handle having an operator surface and an actuator end on said flexible chamber wall;

said bristle face defining a powder exit port, said exit port adjoining an exit passage extending from said bristle face to said chamber such that upon actuation of said operator surface and resultant movement of said flexible chamber wall, said chamber compresses resulting in the ejection of skin powder from said chamber through said exit passage and said exit port into said plurality of bristles extending outward from said bristle face;

a brush stand to support said neck brush about said brush handle;

a sensory means to determine when said neck brush is disposed on said brush stand;

an ultraviolet sanitizing lamp directed at said plurality of bristles and any retained powder captured by said plurality of bristles; and a timer electrically coupled between a power source and said lamp, said timer triggered ON by said sensory means and supplying power to said lamp for a predetermined period of time, and thereafter disconnecting said power from said lamp.

2. A neck brush as claimed in claim 1 wherein said stand includes a base unit, said stand extending upwards from said base and said stand retaining said brush in an upright position such that said plurality of bristles extend downward from said bristle face, said chamber being disposed in said brush handle above said bristle face and the stand supporting said plurality of bristles above said ultraviolet sanitizing lamp, said lamp disposed in said base beneath said plurality of bristles.

3. A neck brush as claimed in claim 2 wherein said brush stand is vertically movable with respect to said base and said sensory means is a switch mechanically coupled to said stand such that said brush causes said stand to move and mechanically actuate said switch to turn ON said lamp.

4. A neck brush as claimed in claim 3 including a cover removably mounted atop said base to cover said brush on said stand, said cover having a transparent wall segment to visually confirm a lamp ON condition and contain any residual powder released by said plurality of bristles.

5. A neck brush as claimed in claim 3 including a battery as said power source and a rechargeable unit to couple said battery to an AC power supply and recharge said battery via a disconnectable coupler.

6. A neck brush as claimed in claim 2 wherein said sensory means being a mechanical switch or an optical switch causing said timer and said lamp to turn ON when said brush handle is on said stand.

7. A neck brush as claimed in claim 6 including a cover removably mounted atop said base to cover said brush on said stand, said cover having a transparent wall segment to visually confirm a lamp ON condition and contain any residual powder released by said plurality of bristles.

8. A neck brush as claimed in claim 2 including a cover removably mounted atop said base to cover said brush on said stand, said cover having a transparent wall segment to visually confirm a lamp ON condition and contain any residual powder released by said plurality of bristles.

9. A neck brush as claimed in claim 1 including a battery as said power source and a rechargeable unit to couple said battery to an AC power supply and recharge said battery via a disconnectable coupler.

10. A neck brush as claimed in claim 1 including a cover removably mounted atop said base to cover said brush on said stand, said cover having a transparent wall segment to visually confirm a lamp ON condition and contain any residual powder released by said plurality of bristles.

* * * * *